US007370934B2

(12) United States Patent
Ito

(10) Patent No.: US 7,370,934 B2
(45) Date of Patent: May 13, 2008

(54) INKJET HEAD HAVING ARRANGEMENT FOR PREVENTING CLOGGING OF FILTER WITH ADHESIVE

(75) Inventor: Atsushi Ito, Nagoya (JP)

(73) Assignee: Brother kogyo Kabushiki Kaisha, Nagoya-shi (JP)

( * ) Notice: Subject to any disclaimer, the term of this patent is extended or adjusted under 35 U.S.C. 154(b) by 392 days.

(21) Appl. No.: 11/187,510

(22) Filed: Jul. 22, 2005

(65) Prior Publication Data

US 2006/0017766 A1 Jan. 26, 2006

(30) Foreign Application Priority Data

Jul. 22, 2004 (JP) ..... 2004-213866

(51) Int. Cl.
*B41J 2/015* (2006.01)

(52) U.S. Cl. ..... 347/20

(58) Field of Classification Search ..... 347/20, 347/22, 43, 67

See application file for complete search history.

(56) References Cited

U.S. PATENT DOCUMENTS 6,634,741 B2 * 10/2003 Kataoka et al. ..... 347/92
6,652,081 B2 11/2003 Shimizu
6,685,310 B2 * 2/2004 Kaga et al. ..... 347/87
6,802,601 B2 * 10/2004 Suzuki et al. ..... 347/86
6,814,435 B1 * 11/2004 Shimada et al. ..... 347/93
6,951,383 B2 * 10/2005 Giere et al. ..... 347/56
7,121,643 B2 * 10/2006 Yamada ..... 347/20
7,137,679 B2 * 11/2006 Tsukada et al. ..... 347/7
7,172,271 B2 * 2/2007 Tominaga et al. ..... 347/68
7,258,420 B2 * 8/2007 Hiraki ..... 347/33
7,264,333 B2 * 9/2007 Silverbrook ..... 347/42
7,264,343 B2 * 9/2007 Harvey et al. ..... 347/93

FOREIGN PATENT DOCUMENTS

JP 2003-145791 5/2003

* cited by examiner

*Primary Examiner*—Shih-Wen Hsieh
(74) *Attorney, Agent, or Firm*—Reed Smith LLP

(57) ABSTRACT

An inkjet head including: (a) a passage defining unit having (a-1) pressure chambers and (a-2) inlets opening in its an inlet defining surface and held in communication with the pressure chambers; (b) a filter plate disposed on the inlet defining surface of the passage defining unit; (c) a frame fixed to the inlet defining surface of the passage defining unit, and having an aperture which is formed therethrough such that the filter plate is surrounded by an inner circumferential surface of the aperture; and (d) an elastic plate disposed within the aperture of the frame, and having communication through-holes held in communication with the respective inlets of the passage defining unit through the filter plate. The frame includes an inward protrusion which protrudes inwardly from the inner circumferential surface of the aperture. The elastic plate includes an outward protrusion which protrudes outwardly from its outer circumferential surface and which is held between the inward protrusion of the frame and the filter plate and/or between the inward protrusion and the passage defining unit.

16 Claims, 8 Drawing Sheets

INKJET HEAD HAVING ARRANGEMENT FOR PREVENTING CLOGGING OF FILTER WITH ADHESIVE

This application is based on Japanese Patent Application No. 2004-213866 filed in Jul. 22, 2004, the content of which is incorporated hereinto by reference.

BACKGROUND OF THE INVENTION

1. Field of the Invention

The present invention relates to an inkjet head operable to eject an ink onto a recording medium, for performing a printing operation on the recording medium.

2. Discussion of Related Art

U.S. Pat. No. 6,652,081 (corresponding to JP-2003-145791A) discloses an inkjet head unit including: (a) a front head unit having (a-1) a cavity plate unit (passage defining unit) having a plurality of inlets opening in an end portion of its upper surface, and (a-2) a piezoelectric actuator (actuator unit) superposed on the upper surface of the cavity plate unit with an adhesive sheet being interposed between the piezoelectric actuator and the cavity plate unit; and (b) an ink tank storing an ink that is to be supplied to the inlets of the cavity plate unit. In this inkjet head unit, a filter plate is fixed to the upper surface of the cavity plate unit so as to cover the inlets. On an upper surface of the filter plate, there are disposed a plurality of tubular sleeves which are held in communication with the respective inlets. Each of the tubular sleeves is fixed at one of its opposite end portions to the upper surface of the filter plate by means of epoxy resin as an adhesive, and is connected at the other end portion to the ink tank. The ink tank and the front head unit are thus held in communication with each other, so that the ink stored in the ink tank can be supplied to the front head unit.

However, in the inkjet head unit disclosed in the above-identified U.S. patent publication in which the plurality of tubular sleeves are disposed to be held in communication with the respective inlets such that each of the tubular sleeves is fixed at its end portion onto the filter plate by the epoxy resin, some of the epoxy resin interposed between the tubular sleeves and the filter plate could project to cover portions of the filter plates opposed to the respective inlets of the cavity plate unit, thereby filling pores of the filter plate.

SUMMARY OF THE INVENTION

The present invention was made in view of the background prior art discussed above. It is therefore an object of the invention to provide an inkjet head unit having an arrangement effective to restrain clogging of a filter plate with an adhesive. This object may be achieved according to a principle of the present invention, which provides an inkjet head including: (a) a passage defining unit having (a-1) plurality of pressure chambers held in communication with respective nozzles, and (a-2) a plurality of inlets opening in an inlet defining surface thereof and held in communication with the plurality of pressure chambers; (b) a filter plate disposed on the inlet defining surface of the passage defining unit, and including a non-peripheral portion which is opposed to the plurality of inlets; (c) a frame fixed to a portion of the inlet defining surface of the passage defining unit which is uncovered by the filter plate, and having an aperture which is formed therethrough such that the filter plate is surrounded by an inner circumferential surface of the aperture; and (d) an elastic member or plate disposed within the aperture of the frame, and having a plurality of communication through-holes which are held in communication with the respective inlets of the passage defining unit through the non-peripheral portion of the filter plate, wherein the frame includes an inward protrusion which protrudes inwardly from the inner circumferential surface of the aperture, and wherein the elastic plate includes an outward protrusion which protrudes outwardly from an outer circumferential surface thereof and which is held between the inward protrusion of the frame and at least one of the filter plate and the passage defining unit.

In the present inkjet head, each of the communication through-holes formed in the elastic plate and a corresponding one of the inlets of the passage defining unit can be held in communication through the non-peripheral portion of the filter plate, with a greatly improved fluid tightness therebetween owing to the presence of the outward protrusion of the elastic plate which is held between the inward protrusion of the frame and the filter plate and/or between the inward protrusion and the passage defining unit, even without bonding the elastic plate and the filter plate to each other. Therefore, the present inkjet head does not suffer from the above-described conventional problem, i.e., clogging of the filter plate with an adhesive interposed between the filter plate and a member (e.g., tubular sleeve) disposed on the filter plate.

The outward protrusion of the elastic plate preferably includes a portion which is held between the inward protrusion of the frame and the filter plate. This arrangement is effective, where the frame and the passage defining unit are bonded to each other by an adhesive interposed therebetween, to effective to prevent the interposed adhesive from projecting or flowing toward the non-peripheral portion of the filter plate, and to accordingly avoid clogging of the filter plate with the adhesive.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

and

Figure 11:
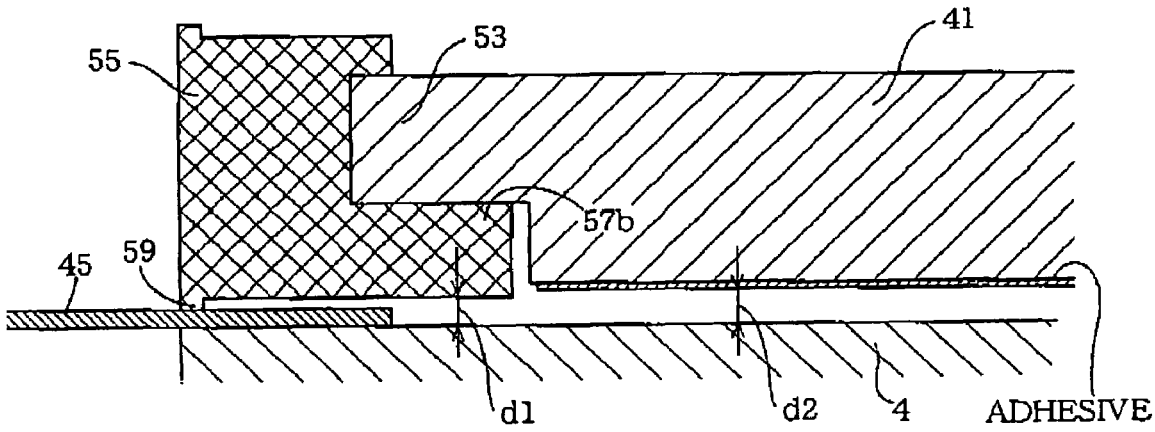

FIG. 11 is a view showing a process of fixing an assembly of the frame and the elastic plate to the main body of the inkjet head.

DETAILED DESCRIPTION OF THE PREFERRED EMBODIMENTS

Figure 1:
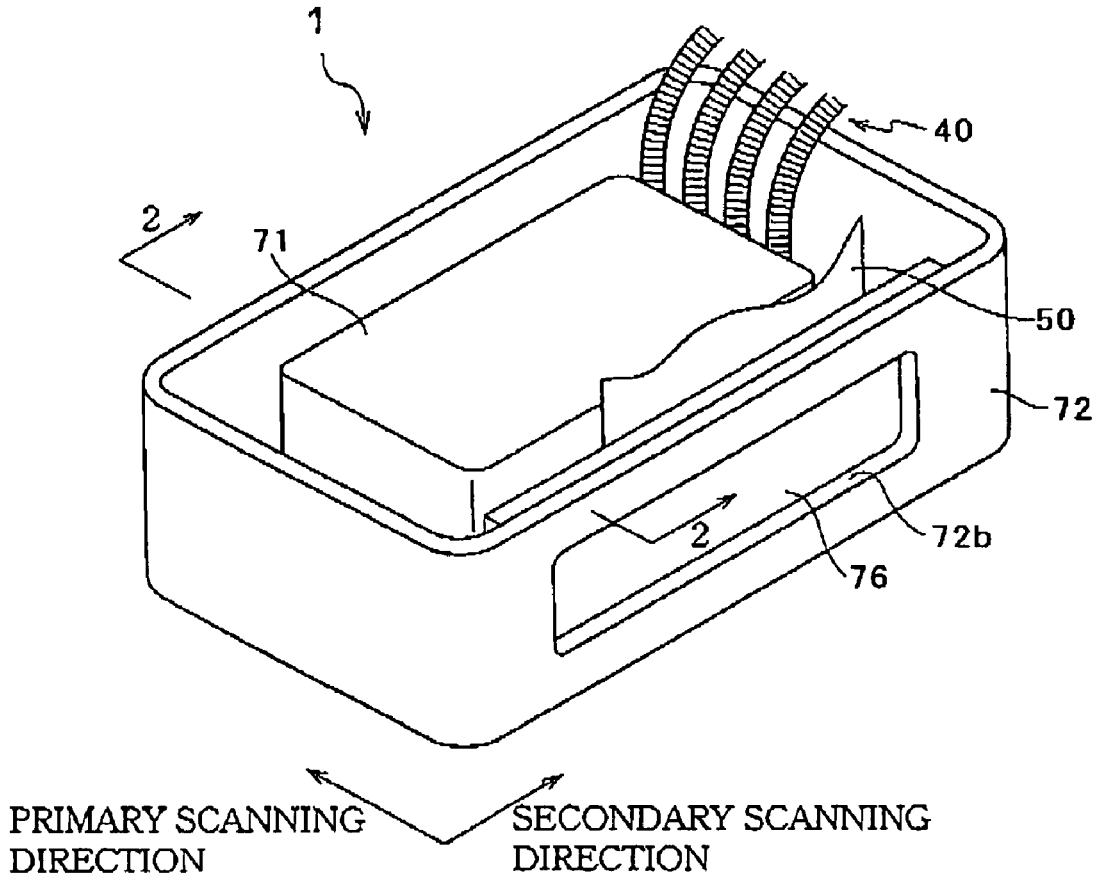
FIG. 1 is a perspective view of an inkjet head constructed according to an embodiment of the invention.
Figure 2:
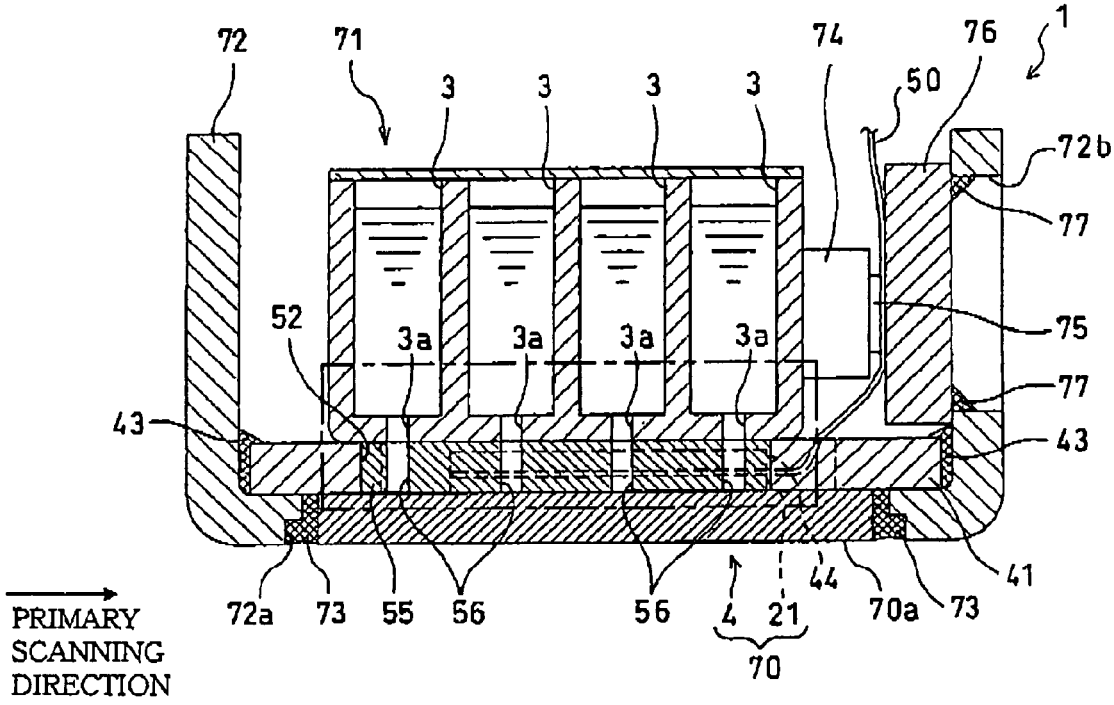
FIG. 2 is a cross sectional view taken along line 2-2 of FIG. 1.
Figure 3:
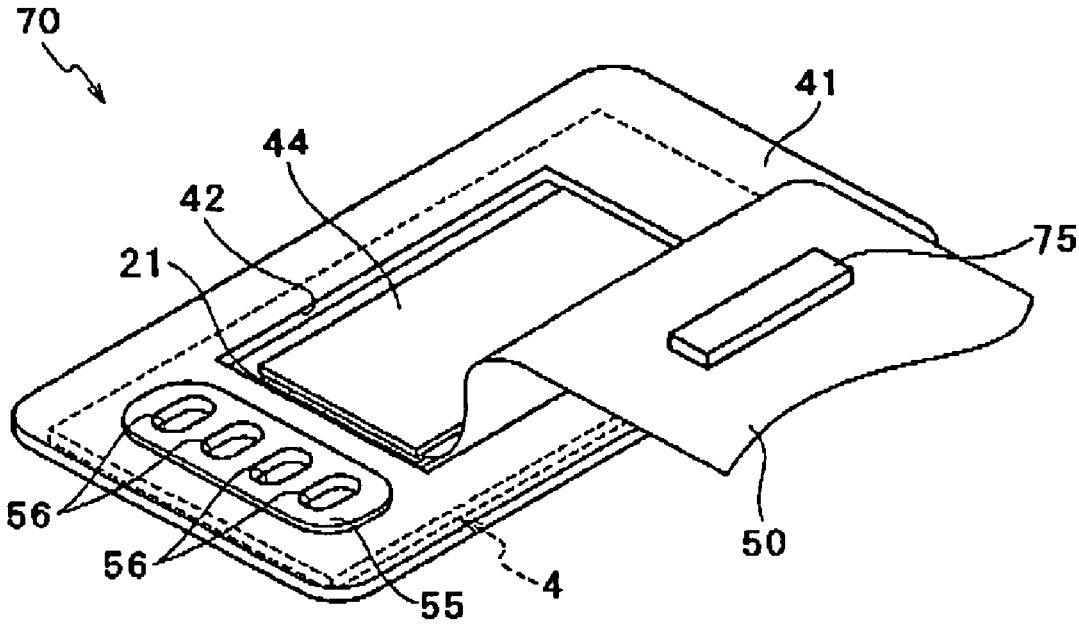
FIG. 3 is a perspective view showing a state in which a frame is bonded to a main body of the inkjet head.

Referring first to FIGS. 1-6, there will be described an inkjet head 1 constructed according to an embodiment of the invention. This inkjet head unit 1 is to be installed on an inkjet printer of serial type (not shown), so as to be operable to perform a recording operation, by ejecting four color inks (e.g., magenta, yellow, cyan and black inks) toward a paper sheet which is fed in a secondary scanning direction. As shown in FIGS. 1 and 2, the inkjet head 1 includes an ink tank 71 which defines therein four ink chambers 3 storing the respective four color inks, and a main body 70 which is located below the ink tank 71. It is noted that the ink tank 71 serves as a presser, as described later.

The ink chambers 3 defined in the ink tank 71 is arranged in a primary scanning direction that is perpendicular to the secondary scanning direction. The black, cyan, yellow and magenta color inks are stored in the leftmost, second leftmost, second rightmost and rightmost chambers 3, respectively, as seen in FIG. 2. The four ink chambers 3 are connected to respective ink cartridges (not shown) via tubes 40 (see FIG. 1), so that the color inks are suppliable to the ink chambers 3 from the ink cartridges via the tubes 40. As shown in FIG. 2, the ink tank 71 is fixed to a generally rectangular frame 41, which has an opening 42 having a rectangular shape in its plan view (see FIG. 3). The main body 70 of the inkjet head 1 is bonded to be fixed to the frame 41, such that an actuator unit 21 of the main body 70 is located in the opening 42. The frame 41 is fixed to a generally rectangular parallelepiped-shaped holder 72 by an ultraviolet curing adhesive 43, such that the ink tank 71 and the main body 70 of the inkjet head 1 are located on upper and lower sides of the frame 41, respectively. The ink tank 71 has four ink outlets 3*a* formed through its bottom wall (see FIG. 2), so that the ink is suppliable from each of the four ink chambers 3 through the corresponding ink outlet 3*a*. The frame 41 supporting the ink tank 71 has an aperture 52 which is formed therethrough and is opposed to the ink outlets 3*a*. Within the aperture 52, there is disposed an elastic member or plate 55 having four communication through-holes 56 formed therethrough and aligned with the respective ink outlets 3*a* formed through the bottom wall of the ink tank 71. This elastic plate 55 is held in contact with the bottom wall of the ink tank 71, so that each of the communication through-holes 56 and a corresponding one of the ink outlets 3*a* are connected to each other to constitute a communication passage. In the present embodiment, each of the ink outlets 3*a* and each of the communication through-holes 56 have a generally elliptic shape in the plan view.

Figure 4:
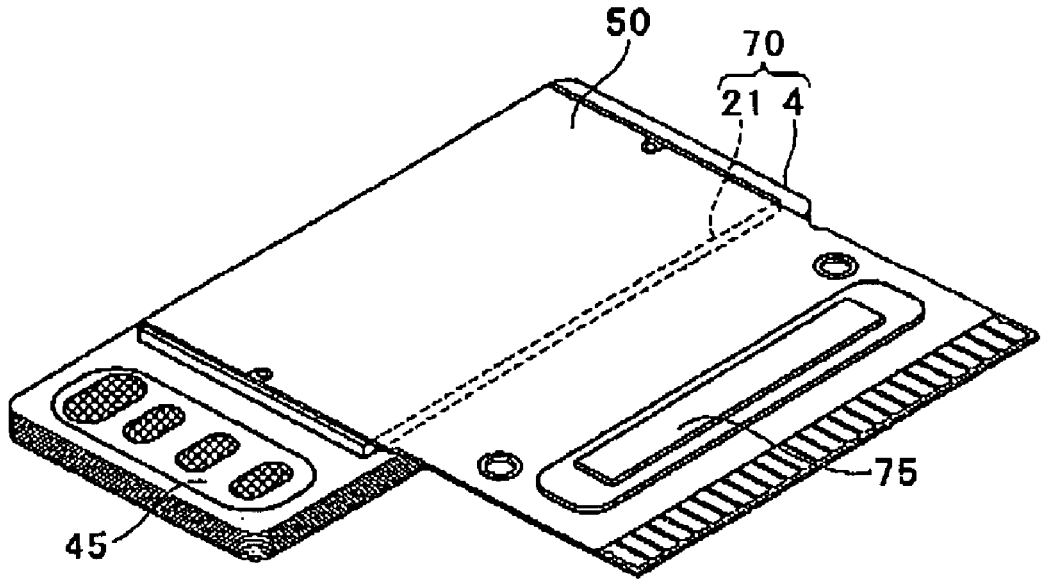
FIG. 4 is a perspective view showing a state in which a flexible printed circuit is fixed to the main body of the inkjet head.

The main body 70 of the inkjet head 1 includes an ink-passage defining unit 4 defining therein a plurality of ink passages which constitute four ink channels corresponding to the four ink colors, and the above-described actuator unit 21 bonded to an upper surface of the ink-passage defining unit 4 by a thermosetting epoxy resin. As shown in FIG. 4, the passage defining unit 4 and the actuator unit 21 are laminar structures each of which includes a plurality of rectangular-shaped thin sheets superposed on each other. The main body 70 including the ink-passage defining unit 4 and the actuator unit 21 is fixed to the frame 41 and is located below the ink tank 71.

A FPC (flexible printed circuit) 50 as a power supplier is fixedly connected at its end portion to the upper surface of the actuator unit 21, and is bent at a boundary between the end portion and the other portion, as shown in FIG. 2. The other portion of the FPC 50 extends upwardly from the boundary which is located on one of end portions of the actuator unit 21 which are opposite to each other as viewed in the primary scanning direction. An aluminum plate 44 is adhered onto an upper surface of the end portion of the FPC 50 which portion is opposed to the actuator unit 21, for protecting the FPC 50 and the actuator unit 21. The aluminum plate 44 serves also as a heat dissipater for dissipating heat generated by individual electrodes disposed on respective portions of the actuator unit 21, so as to minimize temperature variation among the portions of the actuator units 21.

A driver IC 75 is fixed to an intermediate part of the above-described other portion of the FPC 50 extending upwardly along a side surface of the ink tank 71, so that a drive signal output by the driver IC 75 can be transmitted to the actuator unit 21 which is electrically connected to the end portion of the FPC 50 by soldering. An elastic member 74 such as sponge is interposed between the side surface of the ink tank 71 and the driver IC 75.

An opening 72*b* is formed through a side wall of the holder 72 which is opposed to the driver IC 75, as shown in FIG. 2, for dissipating heat generated by the driver IC 75 to an exterior of the inkjet head 1. Between the driver IC 75 and the opening 72*b* of the holder 72, there is disposed a heatsink 76 which is provided by a generally rectangular parallelepiped-shaped aluminum plate. The driver IC 75 and the FPC 50 are forced by the elastic member 74, against the heatsink 76. In this arrangement with the heatsink 76 and the opening 72*b*, the heat generated by the driver IC 75 can be efficiently dissipated. A gap between the side wall of the holder 72 and the heatsink 76 is filled with a sealer 77, which is provided within the opening 72*b* for preventing dust or ink from entering the inkjet head 1.

The ink-passage defining unit 4 underlying the actuator unit 21 has a lower surface in the form of a nozzle defining surface 70*a* in which a multiplicity of nozzles (not shown) open. The multiplicity of nozzles are arranged in a plurality of rows extending in the primary scanning direction, and are distributed in a matrix over substantially the entirety of a portion of the nozzle defining surface 70*a* which portion overlaps with the actuator unit 21 as seen in a plan view of the main body 70 of the inkjet head 1. The ink-passage defining unit 4 defines therein a multiplicity of pressure chambers (not shown) which are arranged on the upper surface of the ink-passage defining unit 4 opposed to the actuator unit 21. The pressure chambers are held in communication with the respective nozzles, and are distributed in a matrix over substantially the entirety of a portion of the upper surface of the passage defining unit 4 which portion overlaps with the actuator unit 21 as seen in the plan view. The ink-passage defining unit 4 further defines therein four manifold chambers (not shown) such that each of the pressure chambers is held in communication with a corresponding one of the four manifold chambers. Four ink inlets 4*a* open in the upper surface of the ink-passage defining unit 4, i.e., in an inlet defining surface of the unit 4 (in which the pressure chambers also open), and are opposed to or aligned with the respective four outlets 3*a* of the ink tank 71. The four ink inlets 4*a* are held in communication with the respective manifold chambers formed in the ink-passage defining unit 4. A filter plate 45 is fixed by an adhesive to a portion of the inlet defining surface in which the ink inlets 4*a* are located, so as to cover the ink inlets 4*a*. The filter plate 45, thus fixed to the ink-passage defining unit 4, is surrounded by an inner circumferential surface of the aperture 52 of the frame 41. The four ink outlets 3*a* of the ink tank 71 are held in communication with the respective four ink inlets 4*a* through the respective four communication through-holes 56 of the elastic plate 55, thereby constituting parts of ink delivery channels communicating the ink chambers 3 of the ink tank 71 with the nozzles of the ink-passage defining unit 4. It is noted that the filter plate 45 has a plurality of micro holes or pores located in its non-peripheral portion which is opposed to the ink inlets 4*a*, so as to allow flow of the ink into the manifold chambers of the ink-passage defining unit 4 while capturing dust or other foreign matters contained in the ink.

Figure 5:
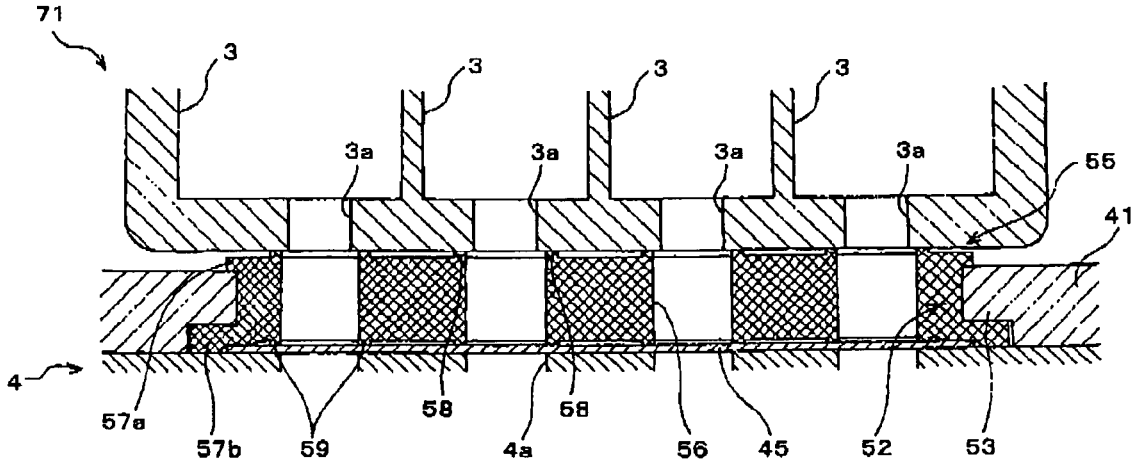
FIG. 5 is a cross sectional view of a portion of the inkjet head, which portion is surrounded by one-dot chain line in FIG. 2.

As shown in FIG. 5, the frame 41 includes an inward projection or protrusion 53 which protrudes inwardly from the inner circumferential surface of the aperture 52. In the present embodiment, this inward protrusion 53 is an annular protrusion extending continuously along the inner circumferential surface of the aperture 52. The inward protrusion 53 protrudes or extends inwardly from the inner circumferential surface of the aperture 52 by a predetermined distance that permits its inner peripheral end to be opposed to an outer peripheral end of the filter plate 45 which is fixed to the ink-passage defining unit 4.

Figure 6:
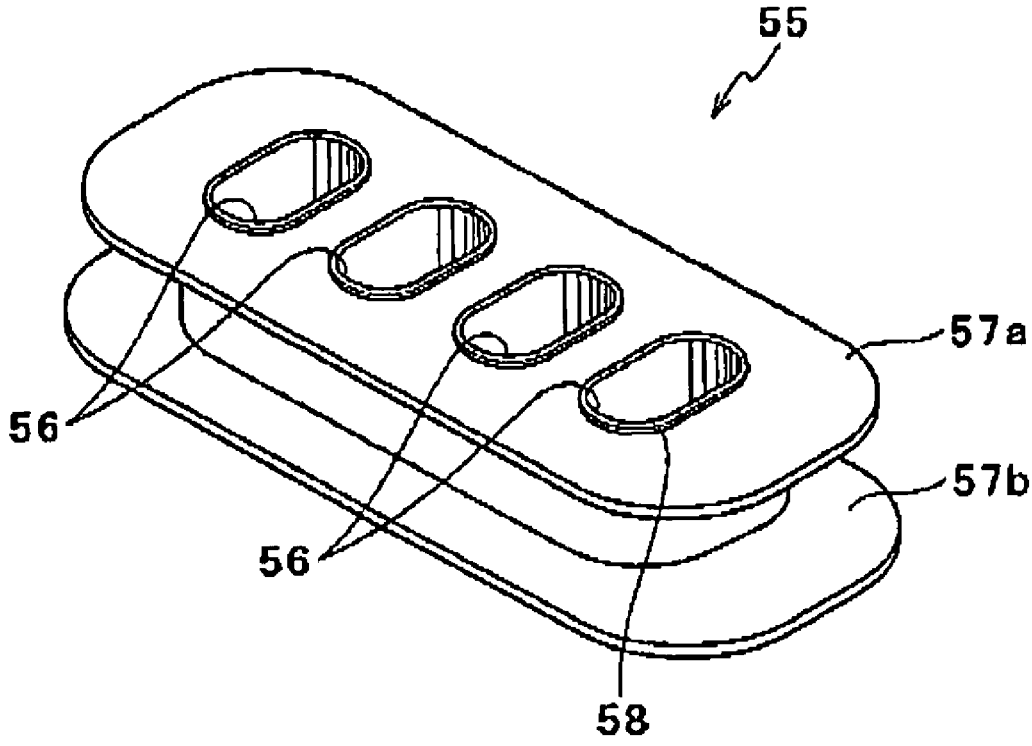
FIG. 6 is a perspective view of an elastic plate which is a component of the inkjet head.

Meanwhile, the elastic plate 55 disposed within the aperture 52 includes an upper flange 57*a* as a second outward protrusion and a lower flange 57*b* as a first outward protrusion. The upper and lower flanges 57*a*, 57*b* protrude outwardly from an outer circumferential surface of the elastic plate 55, and cooperate with each other to grip the inward protrusion 53 of the frame 41 therebetween. In the present embodiment, each of the upper and lower flanges 57*a*, 57*b* is provided by an annular flange (having an annular shape in the plan view), and surrounds the four communication through-holes 56, as shown in FIG. 6. The lower flange 57*b* protrudes or extends outwardly from the outer circumferential surface of the elastic plate 55, up to a vicinity of an opening edge of the aperture 52 on the side of the ink-passage defining unit 4, passing over the outer peripheral end of the filter plate 45. In other words, the lower flange 57*b* has an outer peripheral end which is located between the outer peripheral end of the filter plate 45 and a portion of the inner circumferential surface of the aperture 52 which portion defines the opening edge of the aperture 52 on the side of the ink-passage defining unit 4. The upper flange 57*a* protrudes or extends outwardly from the outer circumferential surface of the elastic plate 55, up to a position precisely opposed to the outer peripheral end of the filter plate 45. That is, the upper flange 57*a* has an outer peripheral end which is opposed to the outer peripheral end of the filter plate 45. The elastic plate 55 further includes four lower-side annular protrusions 59 and four upper-side annular protrusions 58. Each of the lower-side annular protrusions 59, which is formed in the vicinity of periphery of a lower-side or exit-side portion of a corresponding one of the four communication through-holes 56, protrudes downwardly, and surrounds the exist-side portion of the corresponding communication through-hole 56. Each of the upper-side annular protrusions 58, which is formed in the vicinity of periphery of an upper-side or entrance-side portion of a corresponding one of the four communication through-holes 56, protrudes upwardly, and surrounds the entrance-side portion of the corresponding communication through-hole 56.

The frame 41, which is fitted in the elastic plate 55, is bonded to the ink-passage defining unit 4, with the communication through-holes 56 of the elastic plate 55 being aligned with the respective ink inlets 4*a* of the ink-passage defining unit 4, so that the communication through-holes 56 are brought into communication with the respective ink inlets 4*a* through the filter plate 45. In this arrangement, the frame 41 and the ink-passage defining unit 4 (which are held in mutual contact and bonded to each other) cooperate with each other to cause the lower flange 57*b* of the elastic plate 55 to be held or gripped between the filter plate 45 and the inward protrusion 53 and also between the ink-passage defining unit 4 and the inward protrusion 53. Thus, the inward protrusion 53 causes the lower flange 57*b* to be held in pressing contact with the upper surfaces of the filter plate 45 and ink-passage defining unit 4. Further, the elastic plate 55 is pressed against the ink-passage defining unit 4, owing to the presser in the form of the ink tank 71 which is held in pressing contact at its lower surface with the elastic plate 45. Therefore, the upper-side annular protrusions 58 formed on the upper surface of the elastic plate 55 are squashed or compressed by a pressing force exerted by the ink tank 71 as the presser, while the lower-side annular protrusions 59 formed on the lower surface of the elastic plate 55 are squashed or compressed by a pressing force exerted by the ink tank 71 and the frame 41 which is fixed to the ink-passage defining unit 4.

In the inkjet head 1 constructed as described above, the ink stored in the ink tank 71 is supplied to the manifold chambers defined in the ink-passage defining unit 4 via the ink outlets 3*a* of the ink tank 71, the communication through-holes 56 of the elastic plate 55 and the ink inlets 4*a* of the ink-passage defining unit 4, and then distributed from the manifold chambers to the pressure chambers which are also defined in the ink-passage defining unit 4. The ink thus distributed to the pressure chambers is ejected through the nozzles, when the ink in the pressure chambers is given an ejection energy by the actuator unit 21 to which the drive signal output by the driver IC 75 is transmitted via the FPC 50. The communication through-holes 56 of the elastic plate 55 and the respective ink inlets 4*a* of the ink-passage defining unit 4 can be held in communication through the filter plate 45, with an improved fluid-tightness therebetween owing to the presence of the lower flange 57*b* of the elastic plate 55 which is held between the inward protrusion 53 of the frame 41 and the filter plate 45 and also between the inward protrusion 53 and the ink-passage defining unit 4.

Further, in a process of manufacturing the inkjet head 1, when the frame 41 is fixed at its lower surface to the upper surface of the ink-passage defining unit 4 by an adhesive (which is applied preferably to the lower surface of the frame 41), it is possible to prevent the adhesive from projecting or flowing toward the non-peripheral portion of the filter plate 45, owing to the arrangement in which the lower flange 57*b* of the elastic plate 55 is held between the inward protrusion 53 and the filter plate 45 and also between the inward protrusion 53 and the ink-passage defining unit 4. The flow of the adhesive in a direction toward the non-peripheral portion of the filter plate 45 is blocked by the elastic plate 55, thereby restraining clogging of the filter plate 45 with the adhesive. It should be noted that the lower flange 57*b* of the elastic plate 55 is forced by the inward protrusion 53 of the frame 41 downwardly, i.e., in a direction causing the elastic plate 55 to be held in close contact at its lower surface (i.e., one of its opposite side surfaces that is close to the ink-passage defining unit 4) with the upper surface of the filter plate 45, so that the adhesive can be effectively blocked owing to the close contact of the elastic plate 55 and the filter plate 45. Further, since the adhesive is disposed neither between the upper surface of the elastic plate 55 and the ink tank 71 nor between the lower surface of the elastic plate 55 and the filter plate 45, the inkjet head 1 is unlikely to suffer from the above-described problem of the inkjet head unit disclosed in U.S. Pat. No. 6,652,081, i.e., clogging of the pores of the filter plate with the adhesive, which clogging is easily caused if the adhesive interposed between the filter plate and a member (e.g., tubular sleeve) projects to the portion of the filter plate opposed to the ink inlets.

FIG. 11 shows a process of fixing an assembly of the frame 41 and the elastic plate 55 to the ink-passage defining unit 4, by moving at least one of the assembly and the ink-passage defining unit 4 toward the other. In this process, it is preferable that the lower flange 57*b* of the elastic plate 55 has been brought into contact with the ink-passage defining unit 4 before the adhesive applied to the lower surface of the frame 41 is brought into contact with the ink-passage defining unit 4, so that the flow of the adhesive in the direction toward the non-peripheral portion of the filter plate 45 can be reliably blocked by the contact of the lower flange 57*b* and the ink-passage defining unit 4. In the assembly of the frame 41 and the elastic plate 55, before the assembly is fixed to the ink-passage defining unit 4, therefore, there is preferably a step between the lower surfaces of the respective elastic plate 55 and frame 41, which step is larger than the thickness of the applied adhesive, so that a distance d1 is smaller than a distance d2 (d1<d2), where the distances d1, d2 respectively represent a distance between the ink-passage defining unit 4 and the elastic plate 55 and a distance between the ink-passage defining unit 4 and the adhesive (disposed on the lower surface of the frame 41) at a point of time during the movement of the above-described at least one of the assembly and the ink-passage defining unit 4 toward the other in the fixing process.

Further, the elastic plate 55 is held squashed or compressed between the ink tank 71 and the ink-passage defining unit 4, since the ink tank 71 is held in pressing contact at its lower surface with the upper surface of the elastic plate 55 (i.e., one of the opposite side surfaces that is close to the ink tank 71). This arrangement substantially eliminates a gap between the lower surface of the elastic plate 55 and the upper surface of the filter plate 45, which gap would allow the ink inlets 4*a* to be brought into communication with an exterior of the inkjet head 1, thereby assuring an improved fluid-tightness between the elastic plate 55 and the filter plate 45.

If the elastic plate 55 were arranged to be forced downward at its upper surface by the ink tank 71 while simply held in contact at its lower surface with the filter plate 45, there would be a risk that the elastic plate 55 would not be evenly held in contact at the entirety of its lower surface with the upper surface of the filter plate 45. The possibility of such a risk could be increased or reduced depending upon a distance between the upper and lower surfaces of the elastic plate 55 and a direction in which a pressing force is applied to the elastic plate 55. If the elastic plate 55 were forced only at its upper surface, the lower surface of the elastic plate 55 would be partially deformed inwardly and/or outwardly, unless the pressing force is applied to the elastic plate 55 in a direction precisely perpendicular to its upper surface. The inward and/or outward deformation of the lower surface of the elastic plate 55 disables the elastic plate 55 from being evenly held in contact at the entirety of its lower surface with the upper surface of the filter plate 45. In addition, if the elastic plate 55 were forced only at its upper surface where the distance between the upper and lower surfaces of the elastic plate 55 is large, the elastic plate 55 would suffer from a lateral buckling deformation, resulting in an uneven contact of the lower surface of the elastic plate 55 with the upper surface of the filter plate 45. That is, if the elastic plate 55 were pressed only at its upper surface, there would be required difficult adjustments of the direction and amount of the pressing force to be applied to the elastic plate 55. Such a problem is not encountered in the present inkjet head 1 in which the elastic plate 55 is downward forced at its portion relatively close to the filter plate 45, by the inward protrusion 53 of the fame 41, so as to be held in close contact at its lower surface with the filter plate 45.

In the inkjet head 1 constructed as described above, since the lower flange 57*b* of the elastic plate 55 provided by the annular flange is pressed at the entirety of its upper surface by the inward protrusion 53 of the frame 41, the elastic plate 55 is evenly held in contact at the entirety of its lower surface with the upper surface of the filter plate 45, thereby providing an improved fluid-tightness between the elastic plate 55 and the filter plate 45. Further, the outer peripheral end of the lower flange 57*b* is located between the outer peripheral end of the filter plate 45 and the inner circumferential surface of the aperture 52 which defines the opening edge of the aperture 52 on the side of the ink-passage defining unit 4, and is held in close contact with the ink-passage defining unit 4, so that the distance between the inward protrusion 53 of the frame 41 and the ink-passage defining unit 4 is made smaller, by an amount close to a thickness of the filter plate 45, than where the filter plate 45 underlies the entirety of the lower surface of the lower flange 57*b* of the elastic plate 55. This arrangement causes the lower flange 57*b* of the elastic plate 55 to be further pressed against the filter plate 45, and establishes a contact of the outer peripheral end of the lower flange 57*b* with the ink-passage defining unit 4 in addition to the contact of the lower flange 57*b* with the filter plate 45, providing a double seal arrangement which reliably restrains excess adhesive (flowing toward the filter plate 45 from between the frame 41 and the ink-passage defining unit 4) from reaching the non-peripheral portion of the filter plate 45 which is opposed to the ink inlets 4*a*.

Further, since each of the annular protrusions 58, 59, formed on the upper and lower surfaces of the elastic plate 55, is squashed or compressed by the pressing forces exerted by the ink tank 71 and the frame 41, the ink is not likely to leak while flowing from the ink outlets 3*a* to the ink inlets 4*a*. That is, each of the ink outlets 3*a*, a corresponding one of the communication through-holes 56 and a corresponding one of the ink inlets 4*a* are connected with a fluid tightness which is improved by the annular protrusions 58, 59. The provisions of the annular protrusions 58, 59 are effective also to restrain entrance of adhesive or other foreign matters into the communication through-holes 56 of the elastic plate 55, thereby substantially eliminating a risk of clogging of the pores of the filter plate 45 with the excess adhesive flowing toward the filter plate 45 from between the frame 41 and the ink-passage defining unit 4.

Further, since the ink tank 71 serves as the presser which is held in pressing contact with the upper surface of the elastic plate 55, the inkjet head 1 does not require a member or component exclusively serving as the presser, thereby making it possible to reduce the number of components of the inkjet head 1.

Further, since the elastic plate 55 includes the upper flange 57*a* as the second outward protrusion in addition to the lower flange 57*b* as the first outward protrusion, the elastic plate 55 can be prevented from being removed from the frame 41. The provision of the upper flange 57*b* also contributes to an increase in an area at which the elastic plate 55 is held in contact with the lower surface of the ink tank 71, thereby resulting in an improved fluid-tightness between the ink tank 71 and the elastic plate 55.

While the presently preferred embodiment of the present invention has been described above in detail, it is to be understood that the invention is not limited to the details of the illustrated embodiment, but may be otherwise embodied.

Figure 7:
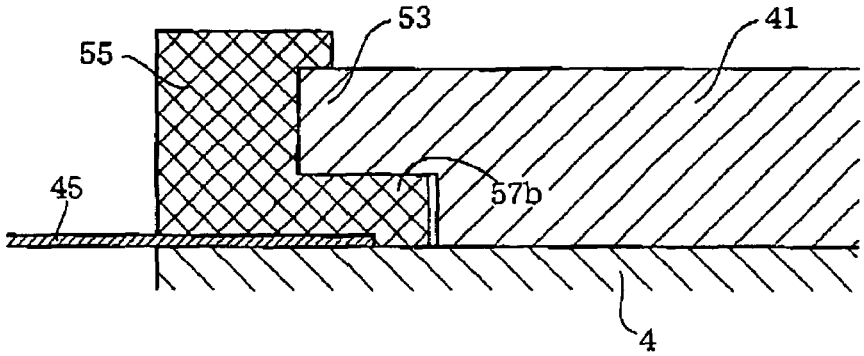
FIG. 7 is a cross sectional view of a portion of the inkjet head in which the elastic plate is gripped by and between the frame and the main body of the inkjet head, in a modified arrangement.

In the above-described embodiment, the inward protrusion 53 of the frame 41 extends inwardly from the inner circumferential surface of the aperture 52 such that the inner peripheral end of the inward protrusion 53 is opposed to the outer peripheral end of the filter plate 45. However, the inward protrusion 53 may further extend so as to overlap with a peripheral portion of the filter plate 45, such that the lower flange 57*b* of the elastic plate 55 includes a portion which is gripped or held between the inward protrusion 53 and the filter plate 45, namely, such that the lower flange 57*b* is held between the inward protrusion 53 and the ink-passage defining unit 4 and also between the inward protrusion 53 and the filter plate 45, as shown in FIG. 7.

Figure 8:
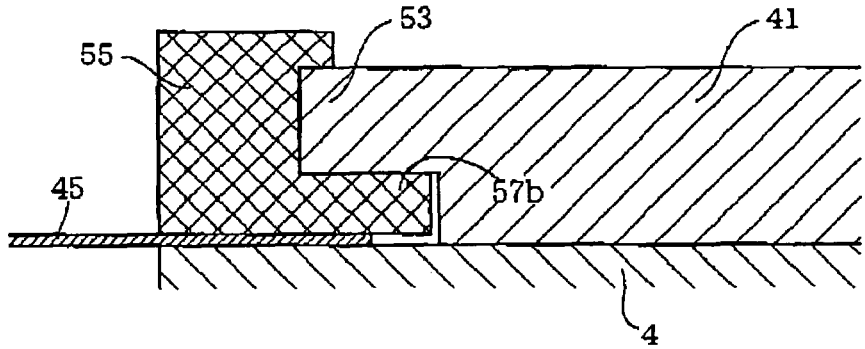
FIG. 8 is a cross sectional view corresponding to the view of FIG. 7, and showing another modified arrangement.
Figure 9:
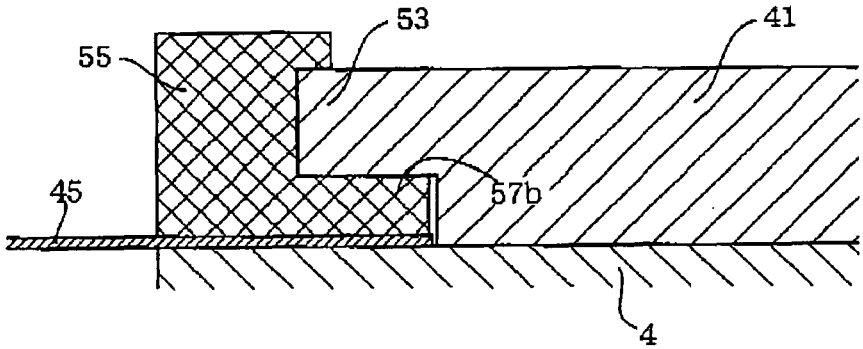
FIG. 9 is a cross sectional view corresponding to the view of FIG. 7, and showing still another modified arrangement.
Figure 10:
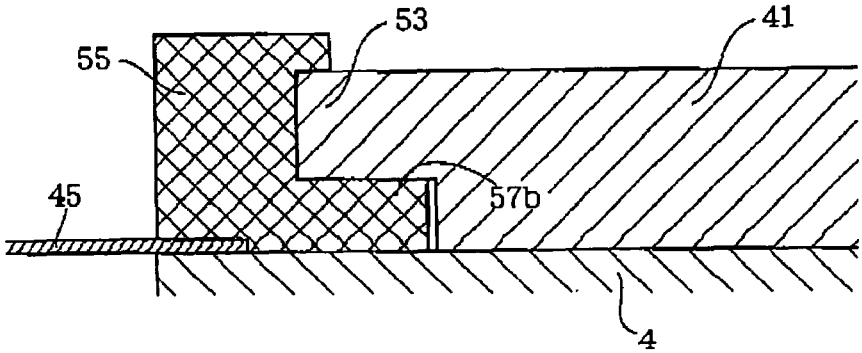
FIG. 10 is a cross sectional view corresponding to the view of FIG. 7, and showing yet another modified arrangement.

In the above-described embodiment, the lower flange 57*b* of the elastic plate 55 is held in contact at its outer peripheral end portion with the ink-passage defining unit 4. However, the lower flange 57*b* does not necessarily have to be in contact with the ink-passage defining unit 4, but may be spaced apart from the ink-passage defining unit 4, as shown in FIG. 8, by a distance corresponding to the thickness of the filter plate 45 (e.g., 5-20 μm) which is interposed therebetween. Further, the outer peripheral end of the filter plate 45 may be located outside of the outer peripheral end of the lower flange 57*b*, such that the lower flange 57*b* is separated from the ink-passage defining unit 4 by the filter plate 45, as shown in FIG. 9. Still further, the outer peripheral end of the filter plate 45 may be located inside of the inner peripheral end of the inward protrusion 53, such that the lower flange 57*b* does not include a portion which is held between the inward protrusion 53 and the filter plate 45, namely, such that the lower flange 57*b* is held only between the inward protrusion 53 and the ink-passage defining unit 4, as shown in FIG. 10. It is noted that, in each of FIGS. 7-10, the above-described annular protrusions 58, 59 formed on the respective upper and lower surfaces of the elastic plate 55 are not illustrated, merely in the interest of simplifying the drawings.

In the above-described embodiment, the filter plate 45 and the frame 41 are bonded to the upper surface of the ink-passage defining unit 4. However, the filter plate 45 and the frame 41 may be otherwise fixed to the upper surface of the ink-passage defining unit 4. For example, the filter plate 45 may be fixed to the ink-passage defining unit 4 only owing to the elastic plate 55 which forces the filter plate 45 against the ink-passage defining unit 4, although it is preferable that the filter plate 45 is bonded or otherwise fixed to the ink-passage defining unit 4 before the assembly of the frame 41 and the elastic plate 55 is fixed to the ink-passage defining unit 4, for eliminating a risk of entrance of dust or other foreign matters into the ink inlets 4*a* in an early stage of the manufacturing process.

In the above-described embodiment, the lower flange 57*b* of the elastic plate 55 is provided by the annular flange having the annular shape in the plan view. However, the lower flange 57*b* may be provided by an otherwise shaped member which can be gripped or held between the inward protrusion 53 and the filter plate 45. For example, the lower flange 57*b* may be provided by a pair of flanges which are located on opposite sides of a row of the communication through-holes 56 and each of which is elongated in a direction parallel with the row of the communication through-holes 56. In this modified arrangement, too, the elastic plate 55 can be forced, at substantially the entirety of its periphery, against the ink-passage defining unit 4 and the filter plate 45, by the inward protrusion 53 of the frame 41, thereby avoiding excess adhesive (flowing toward the filter plate 45 from surrounding of the elastic plate 55) from reaching the non-peripheral portion of the filter plate 45 in the process of bonding the frame 41 to the ink-passage defining unit 4. For assuredly avoiding the adhesive from the reaching the non-peripheral portion of the filter plate 45, an annular protrusion may be formed on the lower surface of the lower flange 57*b* (which is to be held in contact with the filter plate 45 or the ink-passage defining unit 4) so as to surround the ink inlets 4*a*.

Further, as another modified arrangement, the lower flange 57*b* may be provided by a plurality of flanges which are spaced apart from each other in a circumferential direction of the elastic plate 55, In this modified arrangement, each of the plurality of flanges can be held between the inward protrusion 53 and the filter plate 45 and/or between the inward protrusion 53 and the ink-passage defining unit 4, such that the plurality of flanges are evenly held in contact with the filter plate 45 and/or the ink-passage defining unit 4. In this arrangement, too, it is possible to avoid the excess adhesive from reaching the non-peripheral portion of the filter plate 45.

While the elastic plate 55 includes the upper flange 57*a* in addition to the lower flange 57*b* in the above-described embodiment, the upper flange 57*a* is not essential. Further, the annular protrusions 58, 59, formed on the upper and lower surfaces of the elastic plate 55, are not essential, either.

While the elastic plate 55 is arranged to be squashed or compressed between the ink tank 71 (serving as the presser) and the ink-passage defining unit 4 in the above-described embodiment, an additional component or member may be provided to exclusively serve as the presser which is arranged to press the elastic plate 55 against the ink-passage defining unit 4. In this modified arrangement, the additional member preferably has through-holes formed in its portions which are to be opposed to or aligned with the ink inlets 4*a* of the ink-passage defining unit 4. The additional member is preferably positioned relative to the elastic plate 55 in a position that permits the through-holes of the additional member to be opposed to or aligned with the communication through-holes 56 of the elastic plate 55 and that permits outer peripheries of the respective through-holes 56 to be evenly pressed by the additional member.

What is claimed is:

1. An inkjet head comprising:

(a) a passage defining unit having (a-1) plurality of pressure chambers held in communication with respective nozzles, and (a-2) a plurality of inlets opening in an inlet defining surface thereof and held in communication with said plurality of pressure chambers;

(b) a filter plate disposed on said inlet defining surface of said passage defining unit, and including a non-peripheral portion which is opposed to said plurality of inlets;

(c) a frame fixed to a portion of said inlet defining surface of said passage defining unit which is uncovered by said filter plate, and having an aperture which is formed therethrough such that said filter plate is surrounded by an inner circumferential surface of said aperture; and (d) an elastic plate disposed within said aperture of said frame, and having a plurality of communication through-holes which are held in communication with the respective inlets of said passage defining unit through said non-peripheral portion of said filter plate, wherein said frame includes an inward protrusion which protrudes inwardly from said inner circumferential surface of said aperture, and wherein said elastic plate includes an outward protrusion which protrudes outwardly from an outer circumferential surface thereof and which is held between said inward protrusion of said frame and at least one of said filter plate and said passage defining unit.

2. The inkjet head according to claim 1, wherein said filter plate is bonded to said inlet defining surface of said passage defining unit.

3. The inkjet head according to claim 1, wherein said frame is bonded to said portion of said inlet defining surface of said passage defining unit.

4. The inkjet head according to claim 1, wherein said filter plate is bonded to said inlet defining surface of said passage defining unit, wherein said frame is bonded to said portion of said inlet defining surface of said passage defining unit, and wherein said outward protrusion of said elastic plate includes a portion which is held between said inward protrusion of said frame and said filter plate.

5. The inkjet head according to claim 1, wherein said outward protrusion of said elastic plate includes a portion which is held between said inward protrusion of said frame and said filter plate.

6. The inkjet head according to claim 1, wherein said outward protrusion of said elastic plate includes a portion which is held between said inward protrusion of said frame and said passage defining unit.

7. The inkjet head according to claim 1, wherein said outward protrusion of said elastic plate includes a portion which is held between said inward protrusion of said frame and said filter plate, and also a portion which is held between said inward protrusion of said frame and said passage defining unit.

8. The inkjet head according to claim 1, wherein said elastic plate is adjacent at one of opposite side surfaces of said elastic plate to said filter plate, said inkjet head further comprising a presser which is held in pressing contact with the other of said opposite side surfaces of said elastic plate.

9. The inkjet head according to claim 8, wherein said presser is provided by an ink tank which defines therein at least one ink chamber storing an ink that is to be supplied to said plurality of inlets of said passage defining unit.

10. The inkjet head according to claim 1, wherein said inward protrusion of said frame is held in pressing contact with one of opposite side surfaces of said outward protrusion that is remote from said passage defining unit.

11. The inkjet head according to claim 1, wherein said outward protrusion of said elastic plate is provided by an annular flange which extends circumferentially along said outer circumferential surface, and wherein said inward protrusion of said frame is provided by an annular flange which extends circumferentially along said inner circumferential surface.

12. The inkjet head according to claim 1, wherein an outer periphery of said filter plate is spaced apart from said inner circumferential surface of said aperture of said frame, and wherein an outer end portion of said outward protrusion of said elastic plate is opposed to said inlet defining surface of said passage defining unit.

13. The inkjet head according to claim 12, wherein said outer end portion of said outward protrusion of said elastic plate is held between said inward protrusion of said frame and said passage defining unit.

14. The inkjet head according to claim 1, wherein said elastic plate includes, in addition to said outward protrusion as a first outward protrusion, a second outward protrusion cooperating with said first outward protrusion to hold said inward protrusion of said frame, such that said inward protrusion of said frame is held between said first and second outward protrusions.

15. The inkjet head according to claim 1, wherein said elastic plate includes an annular protrusion which is formed on one of opposite side surfaces thereof that is adjacent to said filter plate, and which surrounds each of said plurality of communication through-holes.

16. The inkjet head according to claim 1, wherein said elastic plate includes an annular protrusion which is formed on one of opposite side surfaces thereof that is remote from said filter plate, and which surrounds each of said plurality of communication through-holes.

* * * * *